US008347684B2

(12) United States Patent
Coderre

(10) Patent No.: US 8,347,684 B2
(45) Date of Patent: Jan. 8, 2013

(54) APPARATUS AND METHOD FOR PRODUCING EMBOSSED PAPER OR LAMINATED METALLIC FOIL SHEETS

(75) Inventor: Claude Coderre, Montreal (CA)

(73) Assignee: Imperial Tobacco Canada Limited, Montreal, Quebec (CA)

( * ) Notice: Subject to any disclaimer, the term of this patent is extended or adjusted under 35 U.S.C. 154(b) by 527 days.

(21) Appl. No.: 12/594,286

(22) PCT Filed: Apr. 3, 2008

(86) PCT No.: PCT/EP2008/054059

§ 371 (c)(1),
(2), (4) Date: Feb. 1, 2010

(87) PCT Pub. No.: WO2008/122589

PCT Pub. Date: Oct. 16, 2008

(65) Prior Publication Data

US 2010/0129681 A1 May 27, 2010

Related U.S. Application Data

(60) Provisional application No. 60/910,306, filed on Apr. 5, 2007.

(51) Int. Cl.
*B44B 5/00* (2006.01)
*B21B 1/00* (2006.01)

(52) U.S. Cl. ..... 72/197; 72/184

(58) Field of Classification Search ..... 72/184, 72/196, 197; 101/5, 22; 264/145, 280, 284; 83/27

See application file for complete search history.

(56) References Cited

FOREIGN PATENT DOCUMENTS

| | | | |
|---|---|---|---|
| EP | 1609587 | A1 | 12/2005 |
| EP | 1658965 | A1 | 5/2006 |
| EP | 1897682 | A1 | 3/2008 |
| WO | WO 03/086743 | A1 | 10/2003 |
| WO | WO 2006/092817 | A | 9/2006 |

OTHER PUBLICATIONS

International Search Report and Written Option issued by ISA for PCT/EP08/054059.

International Preliminary Report on Patentability, issued Oct. 6, 2009, for PCT/EP2008/054059, filed Apr. 3, 2008.

*Primary Examiner* — Teresa M Ekiert

(74) *Attorney, Agent, or Firm* — Cooley LLP

(57) ABSTRACT

An apparatus (1) and method for producing embossed paper or laminated metallic foil sheets (55) comprising means for feeding an elongate strip (20) of paper or laminated metallic foil, a pair of matched embossing rollers (5, 10) disposed to receive such a strip from the feeding means, and means for receiving such a strip from the embossing rollers after being embossed thereby, and for cutting such strip into sheets. The rollers have a plurality of embossing sectors (75) arranged on the surface thereof. At least one of the sectors imparts a first embossing, and at least another of the sectors imparts an alternate embossing different in appearance from the first embossing. The sectors are dimensioned similarly to the foil sheets. At least one group of the sheets carry the first embossing while at least another group of the sheets carry the alternate embossing.

25 Claims, 5 Drawing Sheets

APPARATUS AND METHOD FOR PRODUCING EMBOSSED PAPER OR LAMINATED METALLIC FOIL SHEETS

Claim for Priority

This application is a National Stage Entry entitled to and hereby claims priority under 35 U.S.C. §§365 and 371 corresponding to PCT Application No. PCT/EP2008/054059, titled, "Apparatus and method for producing embossed paper or laminated metallic foil sheets," filed Apr. 3, 2008, which in turn claims priority to United States Provisional Patent Application Serial No. 60/910,306, filed Apr. 5, 2007, all of which are hereby incorporated by reference.

FIELD OF THE INVENTION

The present invention relates generally to the embossing of paper or laminated metallic foil. More specifically, the invention relates to an apparatus and a method for roll to roll embossing of paper or laminated metallic foil.

BACKGROUND OF THE INVENTION

Paper sheets and sheets of paper laminated with metallic foil are used in a variety of wrapping and packaging applications. Consumer items, such as confectionery, are often wrapped individually or in bundles in such paper or foil sheets, and cigarettes and cigars are often sold in tins or boxes lined with such foil sheets. Laminated metallic foil sheets are particularly useful as package liners for tobacco products because the metal foil forms a barrier to light and moisture which could degrade the tobacco.

Laminated metallic foil sheets and paper sheets used as wrappers or packaging liners are often embossed to show images such as patterns, trade marks, company names, logos, or other information in order to enhance the presentation of goods wrapped or packaged with such sheets. The embossing may be carried out by well-known processes such as roll to roll embossing, in which a strip of laminated foil or paper is fed and pressed between a pair of embossing rollers.

For example, it is well known in the tobacco industry to use an embossing technology based on passing a laminated metallic foil through a press having two hardened steel embossing rollers, one being a drive roller and the other being driven by the drive roller. In one technique, the embossing rollers are each initially machined with mating die patterns consisting of an array of small pyramidal projections that extend over the entire roller surface. The pyramidal projections act as embossing dies to produce a pattern as the sheet passes between the rollers. In order to create images appearing on the embossed sheet, the pyramidal projections of the drive roller are partly or completely removed in areas that reflect the shape of the image to be depicted. Once embossed, the metallic foil sheet bears the pattern of the pyramidal die array everywhere except for the areas corresponding to the images. The images are thus produced by leaving part of the sheet unembossed while the embossed pattern provides a background for the images. In the present specification, therefore, it will be understood that the term "embossed image" includes an image created by embossing a background pattern that surrounds an unembossed image area.

The embossing rollers used for this type of embossing technique are normally dedicated to a single product line for which the rollers can produce an embossed strip of laminated foil or paper which is then cut into uniform sheets. All of the sheets so produced look exactly the same, bearing the same embossed background pattern and images. Consequently, when a product is to be packaged with sheets bearing different images, for example sheets having written matter in different languages, it is necessary to use different sets of embossing rollers. Each time embossed sheets having different appearances are to be produced, one set of embossing rollers must be switched in the press for another set of embossing rollers. Alternatively, other production lines must be set up with additional embossing presses having different sets of embossing rollers. This is a disadvantage because additional manufacturing costs must be incurred to produce embossed sheets with different images. In the first case, the cost is due to lost production caused by production down time while the embossing rolls are changed. In the second case, the cost is for additional presses and other equipment.

There is therefore a need for an embossing technique that provides added flexibility in the production of different images or embossing patterns on sheets of paper or laminated metal foil.

SUMMARY OF THE INVENTION

It is an object of the present invention to provide an apparatus and method for producing paper or laminated metal foil sheets with different embossed images that do not have the shortcomings of the prior art.

In accordance with a first aspect of the present invention, there is provided an apparatus for producing embossed sheets. The apparatus comprises means for feeding an elongate strip of paper or laminated metallic foil, first and second embossing rollers disposed to receive such a strip from the feeding means, and means for receiving such a strip from the embossing rollers after being embossed thereby, and for cutting such strip into sheets. The first roller has a plurality of embossing die sectors arranged on the surface thereof. At least one of the sectors imparts a first embossed image, and at least another of the die sectors imparts an alternate embossed image different in appearance from the first embossed image. The die sectors are dimensioned similarly to the foil sheets. At least one group of the sheets thus carries the first embossed image while at least another group of the sheets carries the alternate embossed image. The embossing die sectors may be arranged axially along the embossing rollers or circumferentially around the embossing rollers, or both axially and circumferentially. The second embossing roller may also have a plurality of embossing die sectors arranged on the surface thereof arranged to match with embossing die sectors of the first embossing roller.

In accordance with another aspect of the present invention, there is provided a method of producing embossed laminated metallic foil or paper sheets. One step of the method is to emboss a strip of paper or metal foil with at least two groups of die sectors. Each group of die sectors embosses a different image. The strip is then cut into sheets according to the different embossed images.

In accordance with yet another aspect of the present invention, there is provided a batch of a production run of paper or metallic foil sheets for packaging cigarettes. The batch comprises a plurality of embossed sheets having been cut from the same strip. At least one group of the sheets carries a first embossed image, and at least another group of the sheets carries an alternate embossed image.

The present invention thus permits the use of a single production line concurrently to produce paper or laminated metallic foil sheets with different embossed images.

BRIEF DESCRIPTION OF DRAWINGS

These and other features of the present invention will become more apparent from the following description in which reference is made to the appended drawings wherein.

DETAILED DESCRIPTION OF THE INVENTION

The present invention is useful to emboss different images on paper or metallic foil. The invention is compatible with different embossing techniques. For example, the embossing may be performed using a first roller made of a hard material such as steel and a second roller coated with a smooth soft coating such as deformable plastic. Another embossing technique uses two embossing rollers having matching image patterns. In this latter technique, an image is created either by the embossment itself or by embossing a background pattern that surrounds the image.

Figure 1:
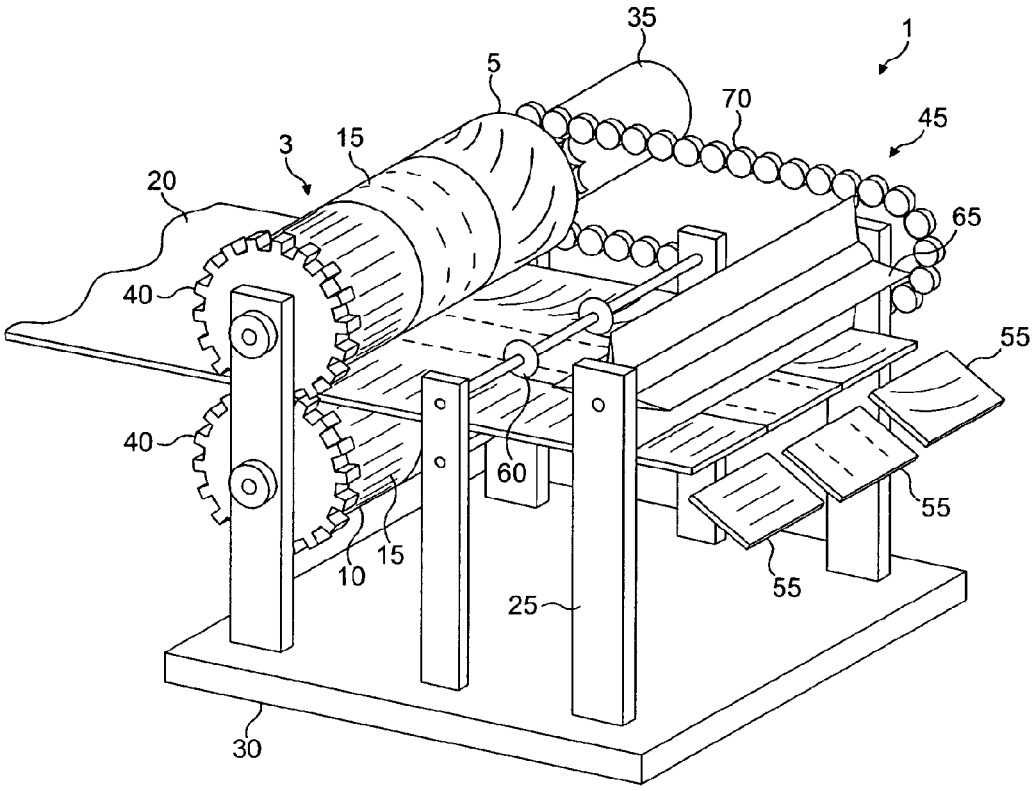
FIG. 1 is a perspective view of an embossing apparatus in accordance with an embodiment of the present invention.

An embodiment of the present invention for producing laminated metallic sheets of a size suitable for use in a pack of cigarettes will now be described. The embossing apparatus 1 shown in FIG. 1 is equipped with an embossing station 3 comprising a first embossing roller 5 and a second embossing roller 10. The diameters of both rollers may be the same, depending on the embossing technology used, and their cylindrical outer surfaces have matching dies 15. In use, both rollers are urged into contact with each other. The rollers 5 and 10 may be made of steel and their contacting surfaces are hardened.

Both the first and second rollers 5 and 10 are rotatably mounted in a frame 30. The first roller 5 may be driven at an appropriate speed through a motor/gearbox assembly 35. The mechanical assembly of the components in the frame of the apparatus can be any of several conventional designs known to those skilled in the art.

The second roller 10 is driven by the first roller 5 through gears 40, which ensures synchronized rotation of the two rollers. Other synchronization means could also be used. For instance, in some situations the matching dies 15 could be sufficient to ensure synchronization between both rollers 5 and 10.

A cutting station 45 is provided to receive and cut an embossed strip of laminated metallic foil 20 into sheets 55 after exiting the rollers 5 and 10. The cutting station 45 is equipped with a longitudinal cutting mechanism 60, a lateral cutting mechanism 65 and synchronizing means 70.

The rollers 5 and 10 are driven while the strip of laminated metallic foil 20 is inserted between them. The pressure and the distance between the two rollers 5 and 10 may be adjusted such that the matching dies 15 engage each other for proper embossing of the strip of laminated metallic foil 20.

Figure 2:
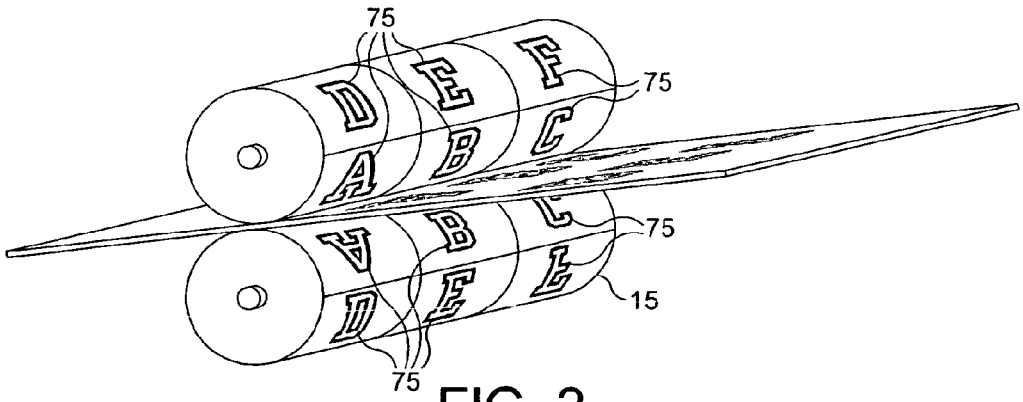
FIG. 2 is a perspective detailed view of an embodiment of embossing rollers used in the embossing apparatus of FIG. 1.

During the embossing operation, the strip of laminated metallic foil 20 is passed between the rotating rollers as shown in FIG. 1. As illustrated in FIG. 2, each roller 5 and 10 has a matching dies 15, comprising for example, surface texturing patterns, pictures, drawings, trade marks, logos, company names of manufacturers, or other information in order to enhance the presentation of goods wrapped or packaged in the sheets 55. The images of the dies 15 have been represented by letters A to F. Each roller 5 and 10 is divided into sectors 75, each containing a different matching dies 15 having a different appearance. For instance, die image A could represent the name of the company while die image B could represent the logo of the company. Each sector 75 has a size corresponding to a size of a sheet 55. The sectors 75 may also be made of a combination of a common characteristic, such as a background pattern, and a different characteristic such as message or logo.

By carefully synchronizing the cutting station 45 with the rollers 5 and 10, the strip of laminated metallic foil 20 may be cut to generate the sheets 55, embossed with different images. Although the synchronizing means 70 is depicted as a chain in FIG. 1, synchronization of the cutting station 45 with the embossing station 3 may be achieved in many different manners. For example, other mechanical means, such as gears, or levers capable of linking an element of the embossing station 3 with an element of the cutting station 45 could be used. For instance, the synchronizing means 70 could be gears transferring the rotation movement from the roller 5 to the transversal cuffing mechanism 65 which takes the form of a set of transverse blades rotating around a transverse axis parallel to the rotation axes of the rollers 5 and 10, thereby ensuring that the strip of laminated metallic foil 20 is always precisely cut to produce the sheets 55.

Figure 5:
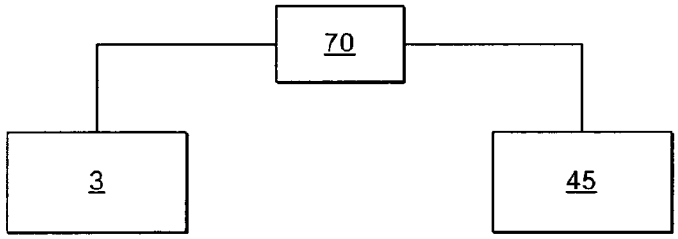
FIG. 5 is a schematic view of an embossing apparatus according to another embodiment of the invention.

Alternatively, the cutting station 45 could be electronically synchronized with the embossing station 3 through a controller monitoring, through sensors, either the rotation speed of the rollers 5 and 10 and actuating the cutting station 45 accordingly or by monitoring the embossed patterns in the strip of laminated metallic foil 20 and activating the cutting station 45 such as to precisely cut the sheets 55. FIG. 5 schematically represent this interaction between the cutting station 45, and the embossing station 3, which are synchronized through the synchronizing means 70.

Figure 3A:
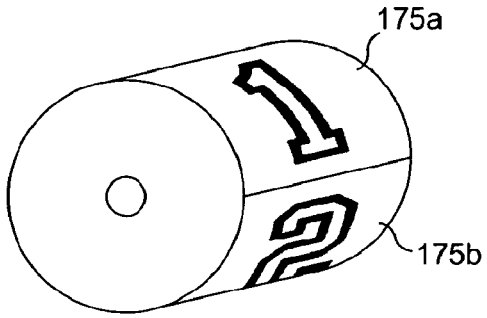
FIG. 3A is a perspective view of another embodiment of one embossing roller of a matching pair of embossing rollers used in the embossing apparatus of FIG. 1.
Figure 3B:
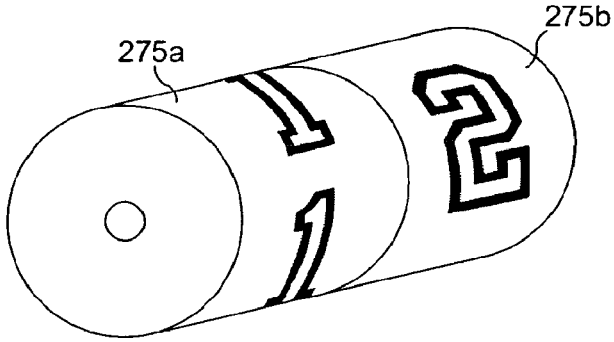
FIG. 3B is a perspective view of an embodiment of another embossing roller of a matching pair of embossing rollers used in the embossing apparatus of FIG. 1.
Figure 3C:
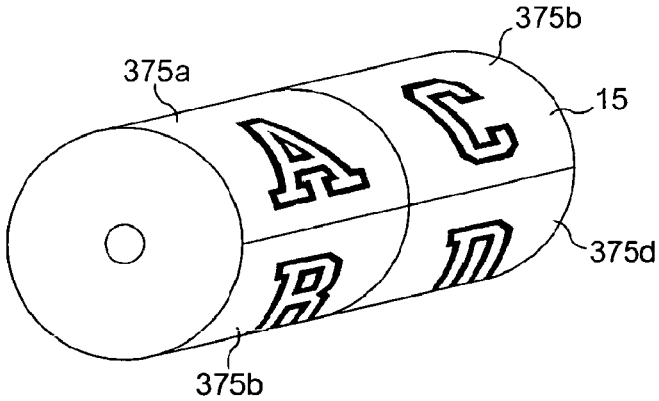
FIG. 3C is a perspective view of an embodiment of another embossing roller of a matching pair of embossing rollers used in the embossing apparatus of FIG. 1.
Figure 4C:
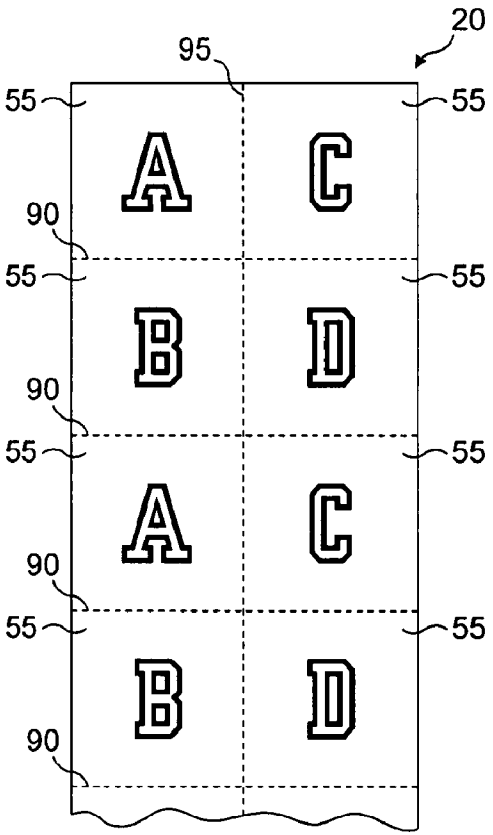
FIG. 4C is a plan view of a foil sheet as produced by a pair of matching rollers similar to the one shown in FIG. 3C.
Figure 4B:
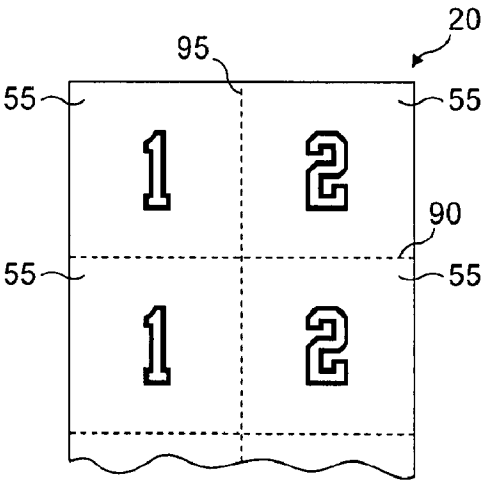
FIG. 4B is a plan view of a foil sheet as produced by a pair of matching rollers similar to the one shown in FIG. 3B.
Figure 4A:
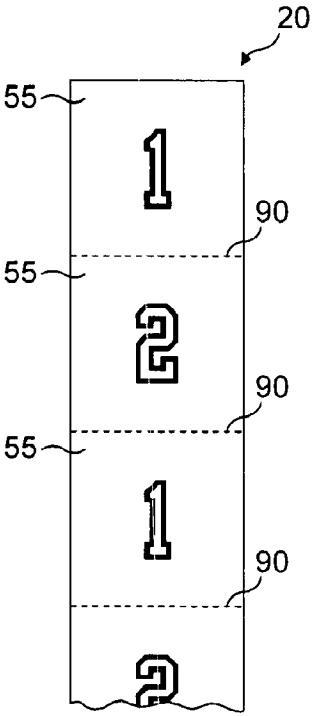
FIG. 4A is a plan view of a foil sheet as produced by a pair of matching rollers similar to the one shown in FIG. 3A.

Turning now to FIGS. 3A, 3B, 3C and corresponding FIGS. 4A, 4B and 4C, three types of rollers and three types of uncut embossed foil sheets are depicted. FIG. 3A shows a roller having two different circumferentially arranged sectors 75. A first sector 175*a* bears the die image "1" while a second sector 175*b* bears the die image "2". This roller has the width of only one sheet 55. The result of the embossing operation, using a pair of rollers having such matching die images, is as shown in FIG. 4A: a sequence of "1" and "2" embossed images respectively corresponding to the first and second sectors 175*a* and 175*b* of the rollers. The strip of laminated metallic foil 20 is subsequently cut precisely along transverse cutting lines 90 by the cutting station 45 to generate the sheets 55.

FIG. 3B depicts a roller having first and second sectors 275*a* and 275*b* arranged along the axis of the rollers. In this example, the rollers have the width of two sheets 55. The result of such an embossment on a strip of laminated metallic foil 20 is represented in FIG. 4B. In this case, the cutting station 45 requires the longitudinal cutting mechanism 60 to cut along the longitudinal cutting lines 95.

The roller shown in FIG. 3C has four sectors 375*a*, 375*b*, 375*c* and 375*d* depicting the die images "A", "B", "C" and "D", arranged both circumferentially and axially. The results of such an embossment on a strip of laminated metallic foil 20 being embossed by rollers having such matching image dies 15 is shown in FIG. 4C.

The person skilled in the art would readily understand that various sectors 75 could be arranged either circumferentially or axially on a set of matching rollers. Placing more sectors 75 circumferentially may increase the diameter of the rollers while placing more sectors 75 axially may increase the width of the rollers. Images can be oriented in any direction to suit the orientation of the sheet 55 on the strip of laminated metallic foil 20.

When the rollers used have two or more die image sectors 75 arranged side-by-side parallel to the longitudinal axis, the cutting station is equipped with the longitudinal cutting mechanism 60. When the strip of laminated metallic foil 20 is only one image wide and the rollers 5 and 10 only have one image die in width, the cutting station 45 is not required to have the longitudinal cutting mechanism 60.

The rollers may have an image die array made up of many different image dies in the various sectors 75, with some of them being present in more than one section on the roller. This allows having a larger proportion of a certain type of image in a production batch.

In use, the strip of laminated metallic foil 20 is fed through the first and second roller 5 and 10 having matching image dies 15. The rollers are placed against each other adequately to properly emboss the strip of laminated metallic foil 20. The rollers 5 and 10 are synchronized with each other through any suitable means. Subsequent to the embossing, the cutting operation is performed by the cutting station 45, synchronized with the embossing station 3 such that sheets 55 are created bearing different embossings as created by the different sectors 75 of the rollers 5 and 10.

It is further possible to use a sorting station after the cutting station. The sorting station sorts the sheets 55 according to the embossing appearing on them. This is accomplished, for example, by having sectors 75 arranged axially along the rollers 5 and by having gates or separators placed at the exit of the cutting station 45 such that sheets 55 are sorted automatically, depending on their lateral position at the exit of the cutting station 45. By using the sorting station in combination with rollers having different sectors 75 arranged both axially and circumferentially, it is possible to produce sheets 55 having different appearance for different products. For example, if rollers 5 have 4 sectors arranged axially and two sectors arranged circumferentially, it is possible to produce two types of sheets 55 having different appearances for four different lines of products.

Figure 6:
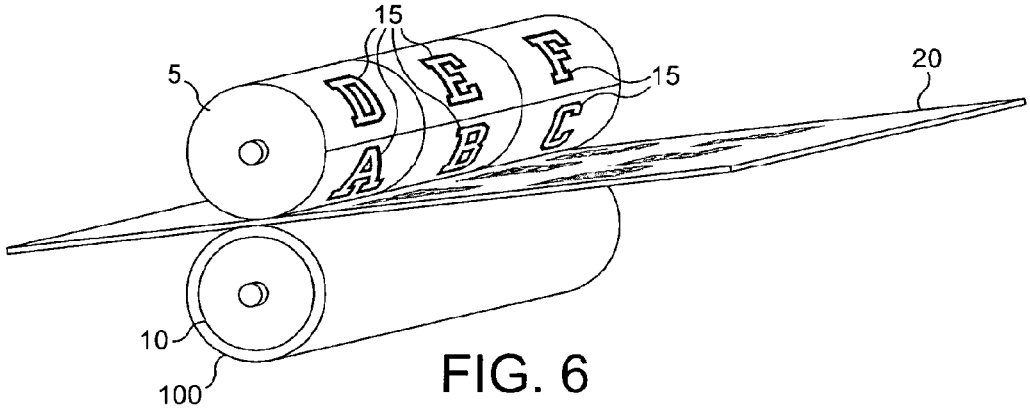
FIG. 6 is a perspective detailed view of an embodiment of embossing rollers used in the embossing apparatus of FIG. 1.

The present invention is compatible with different embossing techniques. For example, FIG. 6 depicts another embodiment of the invention. In this embodiment, the first roller 5 is made of steel with a hardened contacting surface while the second roller 10 has a smooth soft coating of plastic material 100. The image dies 15 of the first roller 5 emboss the strip of laminated metallic foil 20 and in so doing impose an elastic deformation to the plastic material 100 of the second roller 10.

Figure 7:
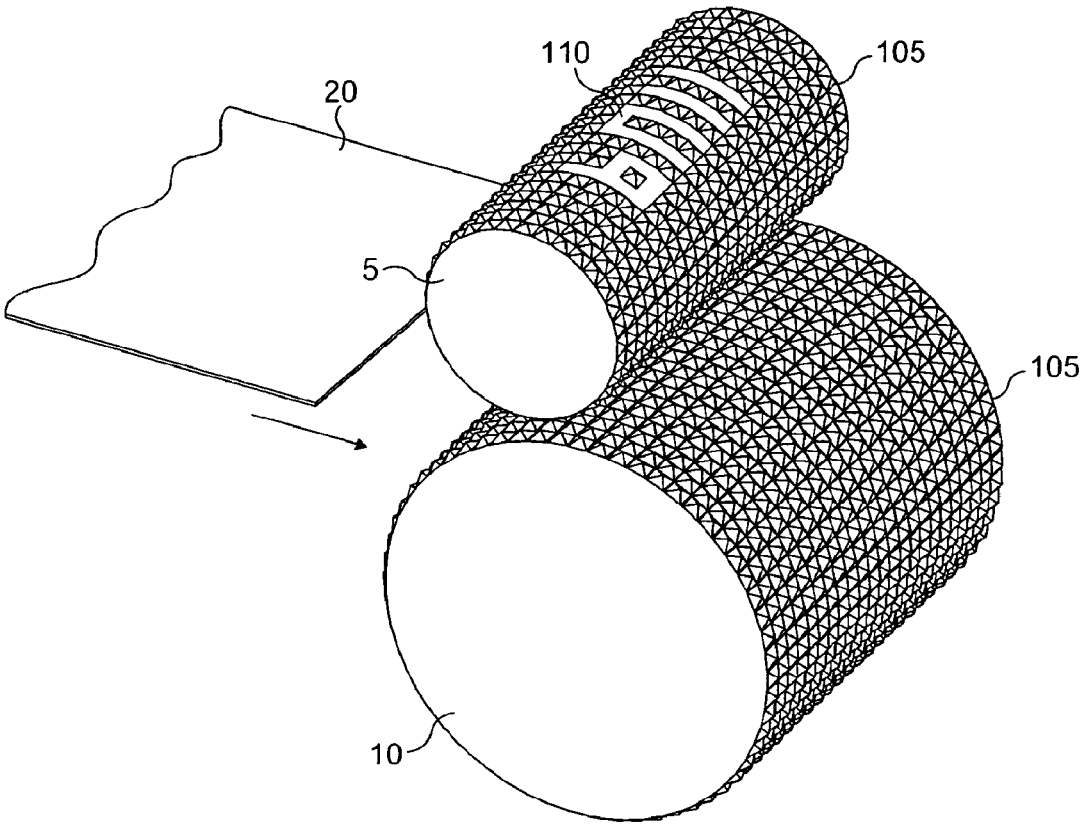
FIG. 7 is a perspective detailed view of an embodiment of embossing rollers used in the embossing apparatus of FIG. 1.

FIG. 7 depicts yet another alternative embossing technique where a shallow pattern 105, such as small pyramids, is engraved on both the first roller 5 and the second roller 10. The laminated metallic foil 20 is passed through both the first roller 5 and the second roller 10. An image die 110 is created on one of the rollers, for example roller 5, by partly or completely removing the shallow pattern 105. This operation may be done by machining. By locally removing the pyramids of the pattern 105, an unembossed image may be created against the background of the embossed pattern. In other words, the laminated metallic foil 20 is embossed everywhere except for an area depicting the image. Both first and second rollers 5, 10 may be made of hardened steel.

The present invention has been described with regard to preferred embodiments. The description as much as the drawings were intended to help the understanding of the invention, rather than to limit its scope. It will be apparent to one skilled in the art that various modifications may be made to the invention without departing from the scope of the invention as described herein, and such modifications are intended to be covered by the present description.

I claim:

1. An apparatus for producing embossed paper or laminated metallic foil sheets, comprising:

means for feeding an elongate strip of paper or laminated metallic foil;

first and second embossing rollers disposed to receive said strip from said feeding means, said first roller having a plurality of embossing sectors arranged on the surface thereof, at least one of said sectors imparting a first embossing, and at least another of said sectors imparting an alternate embossing different in appearance from said first embossing, said sectors being dimensioned similarly to said foil sheets;

means for receiving such a strip from said embossing rollers after being embossed thereby, and for cutting said strip into sheets, at least a portion of said sheets carrying said first embossing, and at least another portion of said sheets carrying said alternate embossing; and a sorting mechanism for sorting said at least one portion of said sheets carrying said first embossing from said at least another portion of said sheets carrying said alternate embossing.

2. The apparatus as defined in claim 1 further comprising synchronization means to synchronize said receiving and cutting means with said embossing rollers.

3. The apparatus as defined in claim 1 wherein said embossing sectors are arranged circumferentially around said first embossing roller.

4. The apparatus as defined in claim 1 wherein said embossing sectors are arranged axially along said first embossing roller.

5. The apparatus as defined in claim 4 wherein said embossing sectors are also arranged circumferentially around said first embossing roller.

6. The apparatus as defined in claim 1 wherein said second embossing roller has a substantially smooth and deformable outer contacting surface.

7. The apparatus as defined in claim 1 wherein said first embossing roller is a drive roller.

8. The apparatus as defined in claim 1 wherein said second embossing roller has a plurality of embossing sectors arranged on the surface thereof, at least one of said sectors imparting a first embossing, and at least another of said sectors imparting an alternate embossing different in appearance from said first embossing, said sectors being dimensioned similarly to said foil sheets, said sectors being arranged to match similar sectors on said first embossing roller.

9. The apparatus as defined in claim 8 further comprising synchronization means to synchronize said receiving and cutting means with said embossing rollers.

10. The apparatus as defined in claim 8 wherein said embossing sectors are arranged circumferentially around said embossing rollers.

11. The apparatus as defined in claim 8 wherein said embossing sectors are arranged axially along said embossing rollers.

12. The apparatus as defined in claim 11 wherein said embossing sectors are also arranged circumferentially around said embossing rollers.

13. The apparatus as defined in claim 8 wherein said sectors are contiguous on said embossing rollers.

14. The apparatus as defined in claim 1 wherein said means for cutting comprises a longitudinal mechanism and a lateral cutting mechanism.

15. The apparatus as defined in claim 1 wherein said embossing rollers are made of steel.

16. An apparatus for producing embossed paper or laminated metallic foil sheets, comprising:

means for feeding an elongate strip of paper or laminated metallic foil;

first and second embossing rollers disposed to receive said strip from said feeding means, said first roller having a plurality of embossing sectors arranged on the surface thereof, at least one of said sectors imparting a first embossing, and at least another of said sectors imparting an alternate embossing different in appearance from said first embossing, said sectors being dimensioned similarly to said foil sheets; and means for receiving such a strip from said embossing rollers after being embossed thereby, and for cutting said strip into sheets, at least a portion of said sheets carrying said first embossing, and at least another portion of said sheets carrying said alternate embossing, wherein said second embossing roller has a plurality of embossing sectors arranged on the surface thereof, at least one of said sectors imparting a first embossing, and at least another of said sectors imparting an alternate embossing different in appearance from said first embossing, said sectors being dimensioned similarly to said foil sheets, said sectors being arranged to match similar sectors on said first embossing roller.

17. The apparatus as defined in claim 16 further comprising synchronization means to synchronize said receiving and cutting means with said embossing rollers.

18. The apparatus as defined in claim 16 further comprising means for sorting said at least one portion of said sheets carrying said first embossing from said at least another portion of said sheets carrying said alternate embossing.

19. The apparatus as defined in claim 16 wherein said embossing sectors are arranged in one of circumferentially around and axially along said first embossing roller.

20. The apparatus as defined in claim 16 wherein said second embossing roller has a substantially smooth and deformable outer contacting surface.

21. The apparatus as defined in claim 16 wherein said first embossing roller is a drive roller.

22. The apparatus as defined in claim 16 wherein said embossing sectors are arranged in one of circumferentially around and axially along said embossing rollers.

23. The apparatus as defined in claim 16 wherein said sectors are contiguous on said embossing rollers.

24. The apparatus as defined in claim 16 wherein said means for cutting comprises a longitudinal mechanism and a lateral cutting mechanism.

25. The apparatus as defined in claim 16 wherein said embossing rollers are made of steel.

* * * * *